United States Patent [19]

Toda

[11] 3,981,033

[45] Sept. 21, 1976

[54] MATTRESS

[75] Inventor: Kooichiro Toda, Hachioji, Japan

[73] Assignee: France Bed Co. Ltd., Tokyo, Japan

[22] Filed: Oct. 10, 1975

[21] Appl. No.: 621,464

[30] Foreign Application Priority Data

| | | |
|---|---|---|
| Oct. 12, 1974 | Japan | 49-122922[U] |
| Oct. 12, 1974 | Japan | 49-122923[U] |
| Apr. 25, 1975 | Japan | 50-56483 |

[52] U.S. Cl. ..... 5/351; 5/261

[51] Int. Cl.[2] ..... A47C 27/00

[58] Field of Search ..... 297/452, 456; 5/351, 5/338, 345 R, 355, 361 R, 361 B, 260, 261

[56] References Cited

UNITED STATES PATENTS

| | | | |
|---|---|---|---|
| 2,425,728 | 8/1947 | Cobb | 5/351 X |
| 2,826,769 | 3/1958 | Drews | 5/351 |
| 2,940,089 | 6/1960 | Koenigsberg | 5/351 |
| 3,099,021 | 7/1963 | Wetzler | 5/353 |
| 3,165,761 | 1/1965 | Ross | 5/351 |
| 3,257,149 | 6/1966 | Fruchte et al. | 297/452 X |
| 3,388,407 | 6/1968 | Harris | 5/338 X |
| 3,425,068 | 2/1969 | Bechtoldt | 5/351 X |

*Primary Examiner*—Paul R. Gilliam
*Assistant Examiner*—Andrew M. Calvert
*Attorney, Agent, or Firm*—Merchant, Gould, Smith, Edell, Welter & Schmidt

[57] ABSTRACT

Disclosed is a mattress comprising a flat-constructed spring assembly, a pair of elastic material sheets which are attached to upper and lower faces of said spring assembly and whose peripheral edge portions are so extended as to form a space at a side peripheral portion of said spring assembly and opposed to each other at their respective tip-ends, and a side-elastic material member formed in said space by subjecting a foamable plastic to foaming-in-place, and a covering means for covering an elastic body consisting of said spring assembly, said elastic material sheets and said side-elastic material member, whereby to eliminate a feeling of physical disorder during the use of the mattress and to prevent a mattress body from being subject to lateral swing or rocking motion.

5 Claims, 9 Drawing Figures

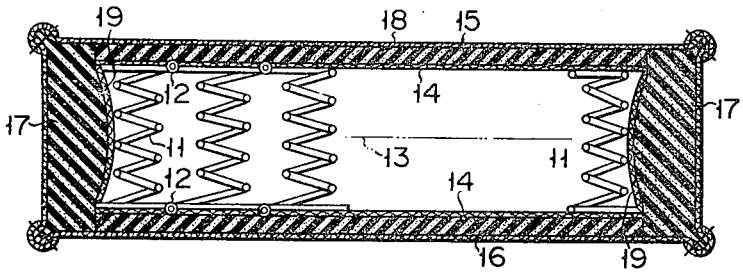
FIG. 1
FIG. 2
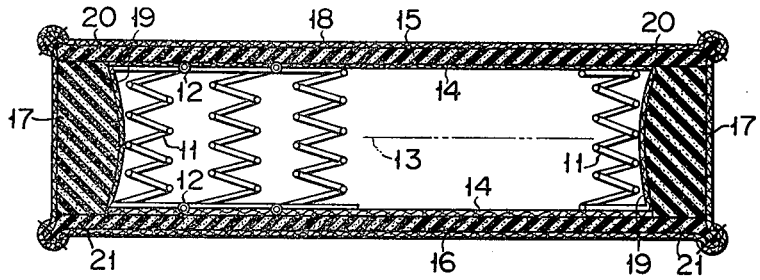
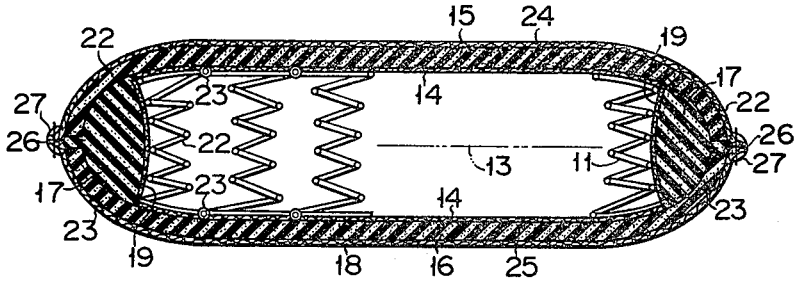
FIG. 3
FIG. 4
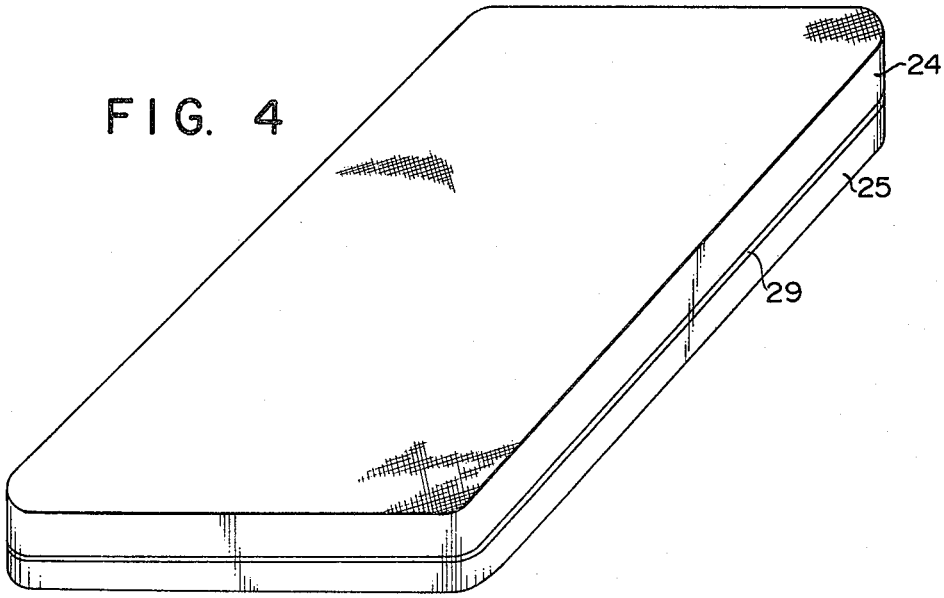

MATTRESS

BACKGROUND OF THE INVENTION

This invention relates to the improvement of a mattress for use in, for example, a bed.

A conventional mattress for use in a bed, as shown in FIG. 1, is comprised of a spring assembly 13 constructed by flat-connecting a plurality of coil springs to each other by helical wires 12, a pair of elastic material sheets 15, 16 formed of, for example, polyurethane foam and attached respectively to the upper and lower faces of the spring assembly 13 through a hessian cloth 14, a side-elastic material member 17 encompassing the outer side periphery of the spring assembly 13, and a covering 18 for covering an elastic body consisting of the spring assembly, the elastic material sheet, and the side-elastic material member. The side-elastic material member 17 is provided for the purpose of reinforcing the side periphery of the spring assembly 13 and preventing the spring assembly 13 from being subject to rocking motion. Further, the side-elastic material member 17 is formed at the side face of the spring assembly 13 by subjecting a foamable plastic to foaming-in-place. Therefore, in order that said foamable plastic is prevented from entering the spring assembly 13, a barrier sheet 19 is stretched at the side face of the spring assembly 13.

On the other hand, there is a mattress wherein the elastic material sheets 15, 16 are so extended as to sandwich the side-elastic material member 17 from above and below, as shown in FIG. 2. In such a mattress, the interiors of the extended portions 20, 21 of the elastic material sheets 15, 16 are impregnated with the foamable plastic in the course of its foaming-in-place by which to form the side-elastic material member 17, and therefore are made stiff and intensified.

In any one of the above-mentioned mattresses, however, there is a great difference in modulus of elasticity between coil springs 11 constituting the spring assembly 13 and the side-elastic material member 17, which results in a drawback of giving a user a feeling of physical disorder. In the mattress shown in FIG. 2 such drawback is indeed lessened as compared with the mattress shown in FIG. 1, but not to a sufficient extent.

In the mattress shown in FIGS. 1 and 2, the covering 18 is constituted by upper and lower lining coverings for covering the surfaces of the paired elastic material sheets and a gusset covering for the outer side periphery of the side-elastic material member, and upper and lower edge portions of this gusset covering and respective peripheral edge portions of said upper and lower lining coverings are sewn up together at two portions — the upper and lower corner portions of the elastic body. The fact that the covering has two sewing-up sections as described above is not preferable from the standpoint of mattress productivity.

Further, sewing-up of the covering is performed usually by a sewing machine, but, in the conventional mattress, portions being sewn up are displaced from each other, so that the resulting sewn-up section becomes disorderly or irregular, that is, has no good appearance. Further, in order to perform the sewing-up of the covering so as to prevent displacement of said portions being sewn up, an expert was required.

This invention has been achieved in view of the above-mentioned circumstances, and an object of the invention is to provide a mattress eliminating a user's feeling of physical disorder as resulting from the difference in elasticity modulus between the side-elastic material member and the coil spring, and capable of reliably preventing a mattress body from being subject to rocking motion.

Another object of the invention is to provide a mattress whose productivity can be raised by providing singly the sewing-up section of the covering and wherein a sewing line of the sewing-up section can be made regular so as to prevent the finished mattress in appearance from having distorted or deformed portions thus to increase the commodity value of the mattress.

Still another object of the invention is to provide a mattress wherein, when a plurality of cloths constituting the covering are sewn up together by a sewing machine, they can with precision and ease be so done at a prescribed position.

The objects of the invention have been achieved through the following characterizing features of the invention.

That is, a first characterizing feature of the invention resides in the respect wherein a mattress of the invention comprises a flat-constructed spring assembly, a pair of elastic material sheets which are attached respectively to upper and lower faces of said spring assembly and whose peripheral edge portions are so extended as to form a space at a side peripheral portion of said spring assembly and are opposed to each other at their respective tip ends, a side-elastic material member formed in said space by subjecting a foamable plastic to foaming-in-place, and a covering means for covering an elastic body consisting of said spring assembly, said elastic material sheets and said side-elastic material member, whereby the respective peripheral edge portions of said elastic material sheets are particularly longitudinally intensified by impregnating said foamable plastic into the whole portions of said respective peripheral edge portions which contact said side-elastic material member.

A second characterizing feature of the invention resides in the respect wherein the mattress is provided with a flange whose inner peripheral portion is embedded in the side-elastic material member and whose outer peripheral portion is drawn outside from the outer side face of the side-elastic material member; and said covering means consists of upper and lower covering sheets which cover upper and lower halves of said elastic body, respectively, and whose peripheral edge portions are sewn up together at the central portion of the side face of said elastic body.

A third characterizing feature of the invention resides in the respect wherein, in the mattress having said flange, to a peripheral edge portion of at least one of said covering sheets being sewn up a guide member functioning as a guide when said peripheral edge portion of said one covering sheet is sewn up together with a peripheral edge portion of the other covering sheet is attached.

BRIEF DESCRIPTION OF THE DRAWING

FIG. 1 is a sectional view of a conventional mattress;

FIG. 2 is a sectional view of another conventional mattress;

FIG. 3 is a sectional view of a mattress according to an embodiment of the invention;

FIG. 4 is a perspective view of a mattress according to an embodiment of the invention wherein the covering is designed to have a single sewing-up section by providing a flange;

DETAILED DESCRIPTION OF THE INVENTION

Figure 5:
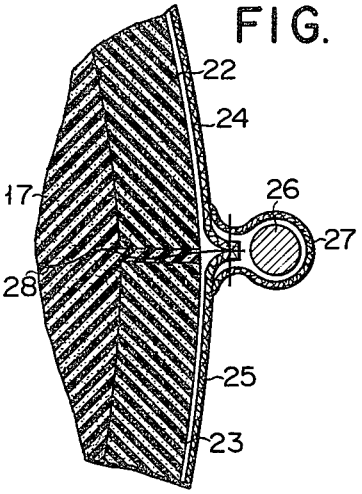
FIG. 5 is a sectional view of the sewing-up section of paired covering sheets of the mattress shown in FIG. 4.

An embodiment of the invention will now be described by reference to the accompanying drawings.

Referring to FIG. 3, a spring assembly 13 is constructed such that a plurality of coil springs 11 are flat-connected by helical wires 12, and a barrier sheet 19 is stretched in the neighbourhood of the entire side periphery of the spring assembly 13. A pair of elastic material sheets 15, 16 formed of foamable plastic are attached or annexed to the upper and lower faces of the spring assembly 13 through a hessian cloth 14. The respective peripheral edge portions 22, 23 of the elastic material sheets 15, 16 are extended in a manner arcuately curved so as to form a space at the side peripheral portion of the spring assembly 13 and are opposed to, or contacted with each other at the tip end. For this reason, the side periphery of the spring assembly 13 is covered by said peripheral edge portions 22, 23 of the sheets 15, 16 through said space. At this space a side-elastic material member 17 is formed by subjecting a foamable plastic to foaming-in-place. That is to say, the spring assembly 13 provided with the barrier sheet 19, hessian cloth 14 and elastic material sheets 15, 16 is set in a mold, and the foamable plastic in introduced from an injection hole bored in the mold into said space through the elastic material sheets 15 and 16 and is subject to foaming-in-place, thereby to form said side-elastic material member 17. When the side-elastic material member 17 is formed in this manner, the foamable plastic is impregnated into the whole inner face portions of the extended portions 22, 23 of the elastic material sheets 15, 16 in the foaming process. Therefore, the whole peripheral edge portions of the elastic material sheets 15, 16 become stiff and as a result are extremely intensified particularly in a longitudinal direction. Further, where there is a clearance between the tip ends of the peripheral edge portions of the sheets 15, 16, this clearance is filled up by part of the side-elastic material member 17.

By intensifying the peripheral edge portions 22, 23 of the elastic material sheets 15, 16 in this manner, a difference in elasticity between the coil spring 11 and the side elastic material member 17 is made extremely small, which does not give a feeling of physical disorder to a user. Further, since the side-elastic material member is encompassed by said extended peripheral edge portions of the elastic material sheets as intensified by impregnation thereinto of the foamable plastic, the lateral swing of the spring assembly 13 is sufficiently prevented with the result that the mattress is prevented from being subject to swinging or rocking motion.

As above described, the mattress of the invention is the one which gives the user no feeling of physical disorder as resulting from the difference in modulus of elasticity between the coil spring and the side-elastic material member and is capable of being prevented from being rocked.

In the mattress shown in FIG. 3, a covering 18 is constituted by upper and lower covering sheets 24, 25, which are sewn up at the central portion of the side of an elastic body consisting of said side-elastic material member 17 and said elastic material sheets 15, 16 in a manner that the peripheral edge portions of the covering sheets 24, 25 sandwich a beading 26 and these peripheral edge portions and beading are covered by a tape 27. In such mattress, however, a sewing line of the sewing-up section becomes irregular, so that there is a fear of the mattress being distorted or deformed.

Next, another embodiment of the invention eliminating the above-mentioned drawback is described.

Figure 6:
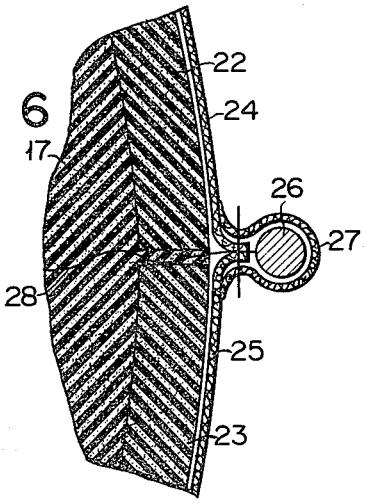
FIG. 6 is a sectional view of another sewing-up section of the paired covering sheets of the mattress shown in FIG. 4.

In the mattress of FIG. 4, the covering is designed to have a single sewing-up section 29 by providing a flange. FIG. 5 shows said sewing-up section. In FIG. 5, the inner peripheral edge portion of the flange 28 is embedded and held in the side-elastic material member 17 and the outer peripheral edge portion thereof is passed between the extended peripheral edge portions 22, 23 of the elastic material sheets and is drawn outside. The covering sheets 24 and 25 are sewn up with the flange 28 and tape 27 in a manner that said drawn, outer peripheral edge portion of the flange 28 is sandwiched between the peripheral edge portions 30, 31 of the covering sheets 24, 25; and said drawn portion of the flange 28 and said peripheral edge portions 30, 31 are covered by the tape 27. The beading 26 is received within this covering tape 27. In FIG. 5, the flange 28 and the beading 26 are separately provided, but as shown in FIG. 6 the beading 26 may be attached to the tip end of the flange 28. The side-elastic material member 17 can be formed in the same manner as in the case of the mattress shown in FIG. 3, that is to say, by subjecting a foamable plastic to foaming-in-place. If, in this case, the flange 28 is sandwiched between the extended peripheral edge portions 22, 23 of the elastic material sheets 15, 16 in a state wherein the outer peripheral edge portion of the flange 28 is drawn outside said extended peripheral edge portions 22, 23 and the inner peripheral edge portion of the flange 28 is drawn through a space formed by the extended peripheral edge portions 22, 23, the inner peripheral edge portion of the flange 28 can be embedded and held in the side-elastic material member 17 formed by injecting a foamable plastic into said space.

In the above-mentioned mattress, accordingly, the covering is only provided with a single sewing-up section 29 at the side face of the mattress, as shown in FIG. 4. By singly providing the sewing-up section which was usually provided in two number, productivity is raised. Further, the peripheral edge portions of the upper and lower covering sheets 24, 25 constituting the covering are sewn up with the outer peripheral edge portion of the flange held by the side-elastic material member 17. Therefore, a sewing line of the sewing-up section is made regular or fixed and the resulting mattress in appearance has no distorted or deformed portions, so that the commodity value of the mattress is increased.

In addition, the sewing operation by a sewing machine is facilitated, which elevates the mattress productivity.

Next, a mattress further improved in the sewing-up section of the mattress shown in FIGS. 5 and 6 is shown.

Figure 7:
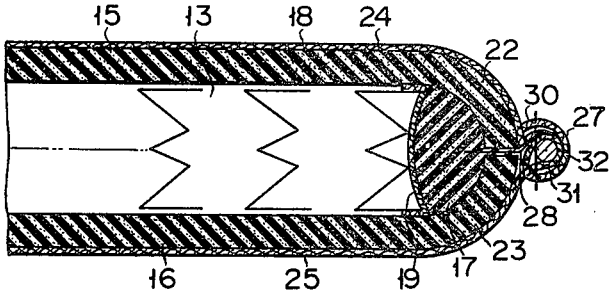
FIG. 7 is a sectional view of a mattress according to another embodiment of the invention wherein a guide member is attached to one of said paired covering sheets.

In FIG. 7, a cord-like guide member 32 is attached to a peripheral edge portion 31 of said lower covering sheet 25. This attachment is performed by encompassing the guide member 32 by said peripheral edge portion 31 in a manner folding back the tip end of this peripheral edge portion 31, and sewing up this folded tip end portion with a base portion of that peripheral edge portion. The covering sheets 24, 25 are sewn up together with the flange 28 and tape 27 at the central portion of the side of the elastic body in a state wherein the flange 28 is sandwiched between the covering sheets 24, 25 and these are covered by the tape 27.

By arranging the sewing-up section as such, sewing of this section can be precisely and easily carried out at a prescribed position in the case of by a sewing machine.

Next, the sewing-up of the covering sheets by a sewing machine is explained with reference to FIG. 8.

Figure 8:
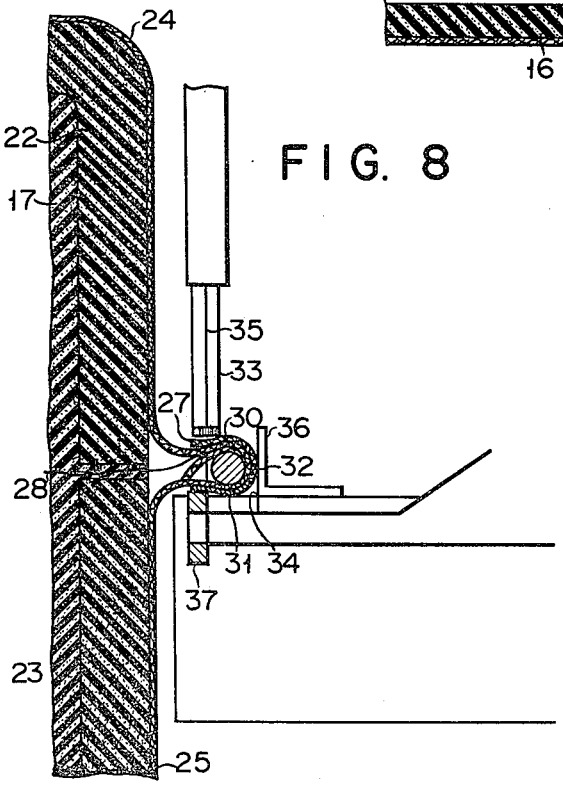
FIG. 8 is a sectional view showing the condition wherein respective peripheral edge portions of the paired covering sheets of the mattress shown in FIG. 7 are sewn up together by a sewing machine.

In FIG. 8, the upper and lower covering sheets 24, 25 sandwiching the flange 28 and covered by the tape 27 are pressed against a bed 34 by a pressure foot 33. The covering sheets 24, 25 are sewn up together with the flange 28 and tape 27 by vertical movement of a needle 35. The sewing machine is provided with a stopper 36 and a bearing 37, and said guide member 32 is pressed from both sides thereof by the stopper 36 and bearing 37 and under this condition the sewing operation is carried out. Thus, sewing of the sewing-up section can be precisely and easily performed at a prescribed sewing position. Note that the bearing 37 functions to press the guide member 32 and to make smooth the feed of the covering sheets 24, 25 following the sewing operation.

Figure 9:
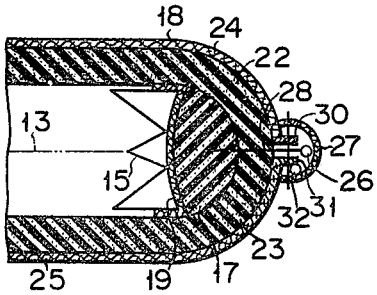
FIG. 9 is a sectional view of a mattress according to still another embodiment of the invention wherein a beading is provided at the tip end of the flange of the mattress shown in FIG. 7.

FIG. 9 shows a modification of the sewing-up section of the mattress shown in FIG. 7. In this modification, the cord-like guide member 32 is attached outside of peripheral edge portion 31 of the lower covering sheet 25, and a beading 26 is provided at the tip end of the flange 28 in a manner bonded or not bonded thereto.

What is claimed is:

1. A mattress comprising a flat-constructed spring assembly, a pair of elastic material sheets which are attached respectively to upper and lower faces of said spring assembly and whose peripheral edge portions are so extended as to form a space at a side peripheral portion of said spring assembly and are opposed to each other at their respective tip ends, and a side-elastic material member formed, by subjecting a foamable plastic to foaming-in-place, in said space through a barrier sheet so stretched as to prevent said foamable plastic from entering said spring assembly, and a covering means for covering an elastic body consisting of said spring assembly, said elastic material sheets and said side-elastic material member, wherein the respective peripheral edge portions of said elastic material sheets are particularly longitudinally intensified by impregnating said foamable plastic into the whole portions of said respective peripheral edge portions which contact said side-elastic material member.

2. A mattress according to claim 1, wherein the peripheral edge portions of said pair of elastic material sheets are extended in an arcuately curved manner.

3. A mattress according to claim 2, which further comprises a flange whose inner peripheral edge portions are embedded in said side-elastic material member and whose outer peripheral edge portions are drawn exteriorly from the side face of said side-elastic material member through said pair of elastic material sheets and sewn up together with said covering sheets constituting said covering means.

4. A mattress according to claim 3, wherein a beading is attached to a tip end of an outer peripheral edge portion of said flange.

5. A mattress according to claim 3, wherein to a peripheral edge portion of at least one of said covering sheets being sewn up a guide member functioning as a guide when said peripheral edge portion of said one covering sheet is sewn up together with a peripheral edge portion of the other covering sheet is attached.

* * * * *